United States Patent [19]

Kumada et al.

[11] 4,392,747

[45] Jul. 12, 1983

[54] DISPLAY DEVICE STRUCTURE

[75] Inventors: Akio Kumada, Kokubunji; Takahiko Ihochi, Koganei; Makoto Homma, Hamuramachi; Masashi Tanaka, Koganei, all of Japan

[73] Assignee: Hitachi, Ltd., Tokyo, Japan

[21] Appl. No.: 199,976

[22] Filed: Oct. 23, 1980

[30] Foreign Application Priority Data

Oct. 24, 1979 [JP] Japan ..... 54-136404

[51] Int. Cl.[3] ..... G04C 23/02; G04C 21/16

[52] U.S. Cl. ..... 368/88; 368/255

[58] Field of Search ..... 368/72–74, 368/245, 250, 251, 255; 340/364 E

[56] References Cited

U.S. PATENT DOCUMENTS

| | | | |
|---|---|---|---|
| 4,004,409 | 1/1977 | Ganter et al. | 368/255 |
| 4,258,432 | 3/1981 | Zafferri et al. | 368/250 |
| 4,271,498 | 6/1981 | Zafferri et al. | 368/255 |

FOREIGN PATENT DOCUMENTS

| | | | |
|---|---|---|---|
| 2215768 | 12/1972 | Fed. Rep. of Germany . | |
| 2326079 | 11/1973 | Fed. Rep. of Germany . | |
| 2334153 | 9/1974 | Fed. Rep. of Germany . | |
| 2247155 | 12/1974 | Fed. Rep. of Germany . | |
| 2746818 | 4/1979 | Fed. Rep. of Germany . | |
| 3021597 | 12/1980 | Fed. Rep. of Germany . | |
| 54-9971 | 1/1979 | Japan | 368/255 |
| 54-97457 | 8/1979 | Japan | 368/255 |
| 1359624 | 7/1974 | United Kingdom | 368/255 |

*Primary Examiner*—Vit W. Miska

*Attorney, Agent, or Firm*—Antonelli, Terry & Wands

[57] ABSTRACT

A display device structure comprising a casing, a display panel placed in the casing, a transparent covering and vibrating plate member on the front side of the display panel and an actuator for the plate member. The covering and vibrating plate member is carried on the casing through an elastic member interposed between the peripheral portion of the plate member and the casing. By this arrangement the plate member is capable of effectively generating sound outward upon reception of vibrating force from the actuator.

13 Claims, 9 Drawing Figures

DISPLAY DEVICE STRUCTURE

The present invention relates to a display device structure which includes a display panel and a sound generator.

In the prior-art display device structure such as a wristwatch with an alarm function (e.g., with a buzzer), a diaphragm is mounted inside of a casing in contact relationship therewith so that vibration of the diaphragm causes sound to give forth, which sound is transmitted outward through one or more openings provided on a back cover. However, problems have been encountered with such a type of writwatch, in that since the diaphragm as a sound generator is covered with the casing and the back cover sound generated is attenuated or lessened before emitted out of the wristwatch, provision of one or more openings on the back cover deteriorates the waterproofness, and the necessity for the diaphragm to be protected results in a thicker wristwatch.

In accordance with the present invention, there is provided a display device structure comprising a casing, a display panel placed in the casing, a transparent covering and vibrating plate member provided on a front side of the display panel and means for causing said plate member to vibrate, wherein the covering and vibrating plate member has its peripheral portion carried on the casing with an electrically conductive elastic member interposed therebetween.

Figure 1:
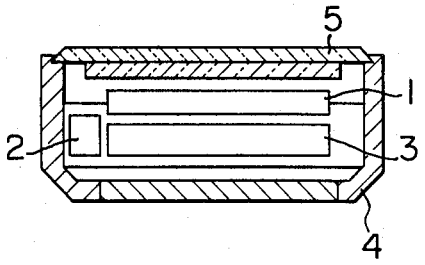
FIG. 1 PRIOR ART
FIG. 1 is a schematic cross-sectional view of a prior-art display device structure.
Figure 2:
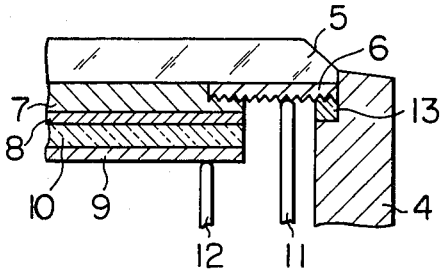
FIG. 2 PRIOR ART
FIG. 2 is a cross-sectional view, on an enlarged scale, of a portion of the structure shown in FIG. 1.

Before describing the present invention, an, explanation will be directed to FIGS. 1 and 2 showing a prior art display device structure, for better understanding of the problems solved by the present invention.

FIGS. 1 and 2 show a display device structure, such as a wristwatch, in which a display panel 1, a driving energy source 2, a driver or module 3, etc. are placed in a watch casing 4 and a transparent cover 5 is provided on the front side of the casing 4 so that direct vibration of the cover 5 causes sound, that is, the cover itself acts as a sound generator. For the vibration of the cover 5 the arrangement is in the following manner. As shown in FIG. 2, the cover 5 is coated at its inner peripheral surface with an electrode 6. A transparent adhesive 7 is provided to apply to the cover 5 and to the electrode 6 a transparent piezoelectric ceramic plate 10 having on its respective surfaces transparent electrodes 8 and 9. The electrodes 8 and 6 are electrically connected to each other (though not shown). A contact 11 is in contact with the transparent electrode 6 provided on the cover 5, while a contact 12 is in contact with the transparent electrode 9 on the lower side of the piezoelectric ceramic plate 10 as viewed in the drawing. With such an arrangement a voltage is applied across the transparent piezoelectric ceramic plate 10 via the contacts 11 and 12 so that the plate 10 vibrates to cause the cover 5 integral with the plate 10 to vibrate, thereby emitting sound. The cover 5 is coupled to the casing 4 through a packing member 13 which provides waterproof and cushioning effect therebetween.

With such an arrangement, however, the vibration will be reduced or weakened because the cover is fixed directly to the casing 4 at its peripheral portion which forms a node of the vibration.

Figure 3:
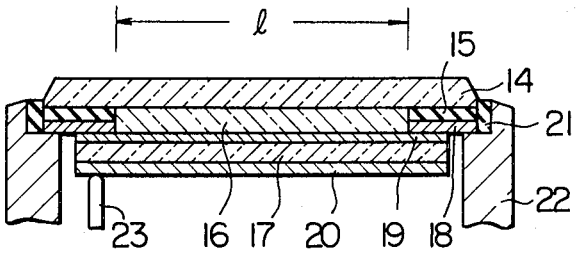
FIGS. 3 to 5, 7 and 8 are schematic cross-sectional views of different embodiments of the display device structure in accordance with the present invention.
Figure 6:
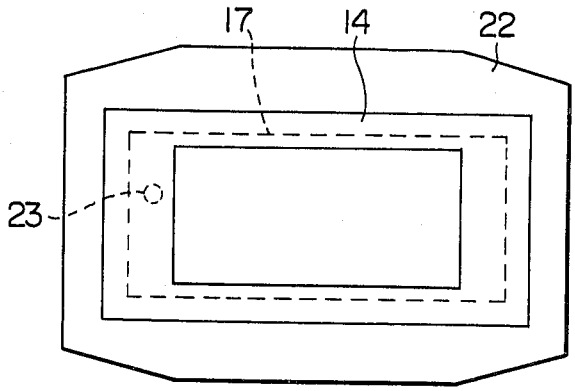
FIG. 6 is a plan view of any one of the display device structures in FIGS. 3 to 5.

Turning now to FIG. 3 and FIG. 6, there is shown an embodiment of a wristwatch in accordance with the present invention in which FIG. 3 is a cross-sectional view of the wristwatch and FIG. 6 is a plan view thereof. The wristwatch has a transparent cover 14 made of, for example, a transparent glass which covers the front face of a display panel and is capable of vibrating to generate sound. The transparent cover 14 has on the lower surface of its peripheral portion a frame-like blind layer 15 printed. The blind layer 15 is optionally provided, but it is useful for providing a geometrically arranged shape of the display area to the display panel, i.e. a good appearance of the wristwatch when viewed from the front side, because the blind layer 15 covers the peripheral edge of the piezoelectric plate 17 which is adhered via a transparent adhesive 16 to the layer under the transparent cover 14. The blind layer 15 may be provided on the transparent cover 14 side with other display symbols, if desired. Further, under the lower surface of the blind layer 15 is formed a frame-like conductive layer 18 such as an evaporated aluminum film. Furthermore, the piezoelectric plate 17 has on both surfaces transparent electrodes 19 and 20 which are made, for example, of $In_2O_3$-$SnO_2$. The transparent electrode 19 on the upper surface of the plate 17 is adhered and electrically connected to the conductive layer 18. The transparent cover 14 is coupled via an elastic packing (such as an elastomer rubber) 21, which is preferably electrically conductive, to an electrically conductive casing 22 in a fitting relationship. The frame-like packing 21 is I-shaped as viewed in a plane widthwise of the cover 14. As a result, the transparent cover 14 is supported elastically at its peripheral portion thereof which functions as a node of vibration, the vibration can take place effectively, thereby to give forth a sufficiently high level of sound. The conductive layer 18 is in electrical contact with the casing 21 so that the electrode 19 is electrically connected with the casing 22. If, however, the packing 21 is of an electrically conductive material, the electrode 19 on the piezoelectric plate 17 is also connected electrically to the casing 22 via the packing 21. It is apparent that electrical connection between the electrode 19 and the casing 22 may be achieved by any other suitable conductive member instead of the conductive layer 18.

Meanwhile, an output contact 33 of the piezoelectric plate 17 is made to contact the transparent electrode 20 right below the blind layer 15. For this reason, the output contact 23 can not be seen from the front side of the wristwatch, because the contact is located out of the indication area (visual area) (shown by l) of the transparent cover 14, as will be seen from FIGS. 3 and 6. A grounding contact for the piezoelectric plate 17 becomes unnecessary as long as the casing 22 is kept at the grounded level, since the transparent electrode 19 of the piezoelectric plate 17 is electrically connected with the conductive layer 18 and the casing 22.

In this embodiment, since the transparent cover 14 is elastically supported, the vibration produced by the piezoelectric plate 17 will not be weakened. This means that sound at a level sufficient for an alarm purpose can be generated outward.

Further, in this embodiment, as long as one of the electrodes of the piezoelectric plate is electrically connected to the casing and the casing is kept at the ground potential, it will be unnecessary to provide a grounding contact for the piezoelectric plate.

Figure 4:
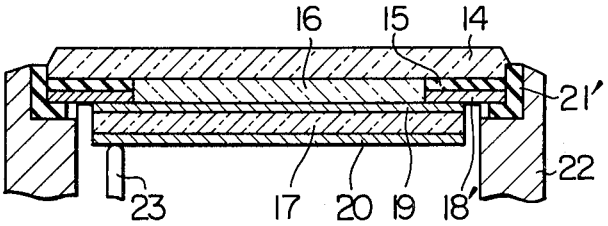

FIG. 4 shows another embodiment of the present invention, in which a frame-like packing 21′ is interposed between a casing 22 and a transparent cover 14 capable of vibrating to generate sound, and is L-shaped as viewed in a plane widthwise of the cover 14. As in the above first embodiment, a frame-like blind layer 15 may not be necessarily provided in this embodiment. Since an electrically conductive layer 18′ is carried on the casing 22 through the L-shaped packing 21′, the packing 21′ must be made of an electrically conductive material. The other structure in FIG. 4 may be the same as that in FIG. 3.

Figure 5:
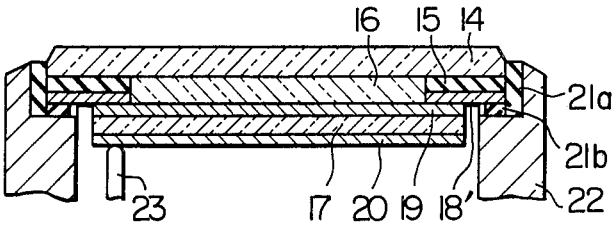

FIG. 5 shows a further embodiment of the present invention. A frame-like packing is interposed between a casing 22 and a transparent cover 14 capable of vibrating to generate sound, and includes two I-shaped pieces 21*a* and 21*b* arranged in an L-shaped form as viewed in a plane widthwise of the cover 14. The other structure in FIG. 5 may be the same as that in FIG. 4. Therefore, the pieces 21*a* and 21*b* must be made of electrically conductive material.

Further, as an alternative, the packing as shown in FIGS. 3 to 5 may be constituted by an adhesive having elasticity (not shown), for elastically securing the transparent cover 14 at its peripheral portion to the casing 22. In this case, the adhesive as the packing may be electrically conductive.

With the embodiments of FIGS. 3 to 6 described above, there have been provided a display device structure which can avoid the attenuation of the generated sound and the deterioration of the water-proof capability. In addition, elimination of the necessity of providing the grounding contact for the piezoelectric plate will allow use of a lesser number of contacts thereof.

Figure 7:
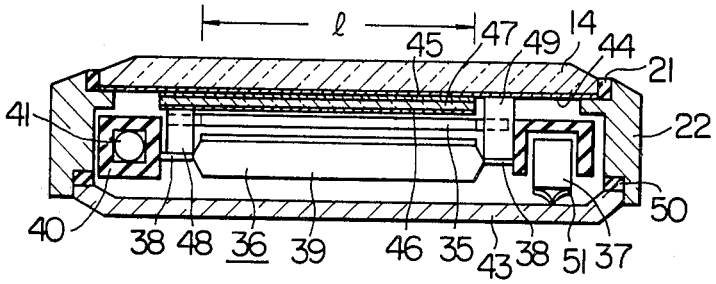

In the embodiment shown in FIG. 7, a contact structure is further employed which facilitates and ensures the electrical connection between a pezoelectric plate that provides a vibration force to a transparent cover of a sound generator and a module that drives the piezoelectric plate.

The wristwatch in FIG. 7 has an electrically conductive watch casing 22. The casing 22 encloses a display panel 35 incorporated with a liquid crystal display unit, a module 36 for driving and controlling the display panel 35, etc, and an electric cell 37 mounted on the module 36. The module 36 includes lead terminals 38, an LSI circuit device unit 39 resin-molded with portions of the two lead terminals 38 and a crystal oscillator 41 mounted on a resin-molded block 40. The casing 22 is covered on the display panel side with a transparent cover 14 capable of vibrating to generate sound and made of, for example, glass, and on the module side with a removable back cover 43. The transparent cover 14, as in the similar way to that in FIG. 3, is fitted at its peripheral portion to the conductive casing 22 by means of an elastic packing 21 which is preferably electrically conductive. Although the frame-like packing 21 is I-shaped as viewed in a plane widthwise of the cover 14 in FIG. 7, it will be easily appreciated that the packing 21 may be replaced with the packing 21′, the packing pieces 21*a* and 21*b* shown in FIG. 4 and FIG. 5. The transparent cover 14 is coated on its inner face with a transparent conductive layer 44. To the central portion of the layer 44 is applied a piezoelectric plate 47 which has on its respective surfaces transparent electrodes 45 and 46. Between the transparent electrode 46 (on the module side) of the piezoelectric plate 47 and one of the lead terminals 38 leading from the LSI unit 39, is disposed in compressed relationship a contact member 48 of an elastic and electrically conductive rubber. The contact member 48 serves as an output contact. In the similar way, between another lead terminal 38 and the transparent conductive layer 44 on the transparent cover 14 is disposed in compressed relationship another contact member 49 of an elastic and electrically conductive rubber. The contact member 49 serves as a grounding electrode. Here in this embodiment in order for the output and grounding conductive members 48 and 49 not to be seen from the front side of the wristwatch, they must be located out of the indication area (visual area) (shown in FIG. 7 by l) of the transparent cover 14. The this end, a frame-like blind layer 15 as shown and described with reference to FIGS. 3 to 5 may be provided at the lower peripheral surface of the transparent cover 14. As a result, only the indication area of the liquid crystal display panel 35, i.e., of the transparent cover 14 can be seen when viewed from the front side of the wristwatch. The piezoelectric plate 47 vibrates when a voltage is applied between the output and grounding conductive rubber members 48 and 49 thereof, since the transparent conductive layer 44 is in electrical contact with the adhesive side transparent electrode 45 of the piezoelectric plate 47, this vibration of the plate 47 causes the transparent cover 14 to vibrate, thereby generating an alarm sound. On the other hand, the back cover 43 is fitted to the casing 22 in an air-tight relationship with the casing 22 by means of a packing 50. Reference numeral 52 designates a contact for the electric cell.

With the wristwatch of the type described above, the assembling can be carried out in such a manner that openings are formed at the pheripheral portion of the display panel 35 and the conductive rubber members 48 and 49 are inserted into the associated openings between the lead terminals 38 and the associated electrode 46 and the conductive layer 44, thereby providing a tightly compressed contact structure beneath the transparent cover 14. In this connection, the diameter of each conductive rubber member 48 or 49 may be determined so as to be slightly larger than that of each opening in the display panel 35 to avoid the slipping of the once-inserted conductive members out of the associated openings, allowing easy assembling.

Figure 8:
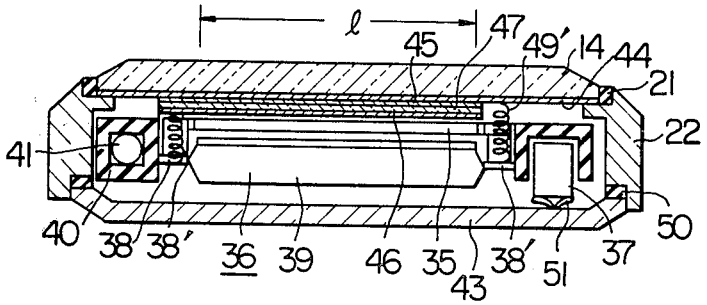

Referring to FIG. 8, electrically conductive coiled springs 38 and 38′ are employed in place of the elastic contact members of an electrically conductive rubber in FIG. 7. More specifically, the spring 38 is interposed in pressure engagement between one of the lead terminals of an LSI circuit device unit 39 and a transparent conductive layer 44 for electrical connection therebetween while the spring 38′ is interposed in pressure engagement between another terminal of the LSI unit 39 and a transparent electrode 46 of the piezoelectric plate 47 for electrical connection therebetween. The other structure may be the same as that in FIG. 7. Therefore, the packings and/or blind layers as shown and described with reference to FIGS. 3 to 5 may be added to the structure of FIG. 8.

Figure 9:
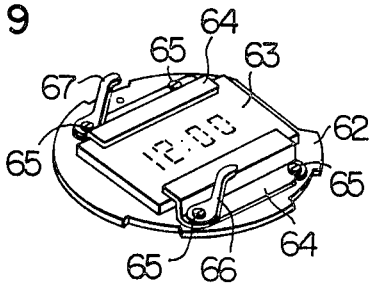
FIG. 9 is a perspective view of a portion of a wristwatch having grounding and output contacts.

In the watch shown in FIG. 9, a grounding contact and an output contact are constituted by leaf springs 66 and 67 which are mounted on a ceramic plate 62 by means of mounting screws 65 for holders 64, the holders securing a liquid crystal panel 63 on the ceramic plate 62. In this case, it is necessary to electrically insulate at least the output contact 67 from the holder 64 and the ceramic plate 62. It will be obvious that the packings, pieces and frame-like blind layers shown and described in FIGS. 3 to 5 may be also added to the watch.

The above-mentioned embodiments of the display device structure with reference to FIGS. 7 to 9 have additional advantages over the embodiments shown in FIGS. 3 to 6 in that necessary electric connection is ensured between the piezoelectric plate mounted on the transparent covering glass and the module and further assembling is facilitated.

In addition, the present invention may be applied not only to a watch but also to a device having a display such as a calculator and a radio receiver.

What we claim is:

1. A display device structure comprising an electrically conductive casing; a display panel placed in the casing; a transparent covering and vibrating plate member having its peripheral portion carried on the casing and being on a front side of the display panel; a transparent piezoelectric plate and a pair of transparent electrodes sandwiching the piezoelectric plate, the piezoelectric plate and electrodes being secured to and integral with the covering and vibrating plate member so that mechanical force produced by the piezoelectric plate is effectively transmitted to the plate member, wherein an elastic and electrically conductive member is provided between the peripheral portion of the plate member and the casing; and a double layer including a frame-like blind layer and an electrically conductive frame-like layer, the frame-like blind layer being in contact with the peripheral portion of the plate member and the electrically conductive frame-like layer being in electrical contact with the casing.

2. A structure according to claim 1, wherein the elastic and electrically conductive member is I-shaped as viewed in a plane widthwise of the plate member.

3. A structure according to claim 1, wherein the elastic and electrically conductive member is L-shaped as viewed in a plane widthwise of the plate member.

4. A structure according to claim 1, wherein the elastic and electrically conductive member includes two I-shaped elastic and electrically conductive pieces arranged in an L-shaped form as viewed in a plane widthwise of the plate member.

5. A structure according to claim 1, wherein the elastic and electrically conductive member is an elastic and electrically conductive adhesive.

6. A structure according to claim 1, further comprising a module having terminals arranged to be powered by an electric cell for driving at least one of the display panel and the piezoelectric plate and at least two contact members having elasticity and being electrically conductive, each of the contact members being in pressure engagement with some of the terminals of the module and the transparent electrodes of the peizoelectric plate for electrical connection between the module and the piezoelectric plate.

7. A structure according to claim 6, wherein each of the contact members includes an electrically conductive rubber member.

8. A structure according to claim 6, wherein each of the contact members includes a spring.

9. A display device structure comprising an electrically conductive casing, a display panel placed in the casing, a transparent covering and vibrating plate member having its peripheral portion carried on the casing and being on a front side of the display panel, and a transparent piezoelectric plate and a pair of transparent electrodes sandwiching the piezoelectric plate, the piezoelectric plate and electrodes being secured to and integral with the covering and vibrating plate member so that mechanical force produced by the piezoelectric plate is effectively transmitted to the plate member, wherein an elastic and electrically conductive packing member is provided between the peripheral portion of the plate member and the casing, said packing member electrically interconnecting one of said electrodes and said electrically conductive casing.

10. A structure according to claim 9, wherein the elastic and electrically conductive packing member is I-shaped as viewed in a plane widthwise of the plate member.

11. A structure according to claim 9, wherein the elastic and electrically conductive packing member is L-shaped as viewed in a plane widthwise of the plate member.

12. A structure according to claim 9, wherein the elastic and electrically conductive packing member includes two I-shaped elastic and electrically conductive pieces arranged in an L-shaped form as viewed in a plane widthwise of the plate member.

13. A structure according to claim 1, wherein the elastic and electrically conductive packing member is an elastic and electrically conductive adhesive.

* * * * *